US006867279B2

(12) United States Patent
Wu

(10) Patent No.: US 6,867,279 B2
(45) **Date of Patent: *Mar. 15, 2005**

(54) GOLF BALL COMPRISING SATURATED POLYURETHANES AND METHODS OF MAKING THE SAME

(75) Inventor: Shenshen Wu, North Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 65 days.

This patent is subject to a terminal disclaimer.

(21) Appl. No.: 10/194,057

(22) Filed: Jul. 15, 2002

(65) Prior Publication Data

US 2003/0088048 A1 May 8, 2003

Related U.S. Application Data

(63) Continuation-in-part of application No. 09/466,434, filed on Dec. 17, 1999, now Pat. No. 6,476,176.

(51) Int. Cl.[7] ..... A63B 37/12

(52) U.S. Cl. ..... 528/61; 528/65; 528/76; 528/80; 528/83; 473/374; 473/378

(58) Field of Search ..... 528/61, 65, 76, 528/80, 83; 473/374, 378

(56) References Cited

U.S. PATENT DOCUMENTS

| | | | | | |
|---|---|---|---|---|---|
| 3,147,324 | A | | 9/1964 | Ward | 264/254 |
| 3,264,272 | A | | 8/1966 | Rees | 260/78.5 |
| 3,454,280 | A | | 7/1969 | Harrison et al. | 273/235 |
| 3,819,768 | A | | 6/1974 | Molitor | 260/897 B |
| 4,123,061 | A | | 10/1978 | Dusbiber | 273/220 |
| 4,323,247 | A | | 4/1982 | Keches et al. | 273/235 R |
| 4,431,193 | A | | 2/1984 | Nesbitt | 273/235 R |
| 4,526,375 | A | | 7/1985 | Nakade | 273/235 R |
| 4,844,878 | A | | 7/1989 | Sullivan et al. | 273/235 R |
| 4,911,451 | A | | 3/1990 | Sullivan et al. | 273/235 R |
| 5,006,297 | A | * | 4/1991 | Brown et al. | 264/234 |
| 5,334,673 | A | | 8/1994 | Wu | 273/235 R |
| 5,484,870 | A | | 1/1996 | Wu | 528/28 |
| 5,692,974 | A | | 12/1997 | Wu et al. | 473/377 |
| 5,733,428 | A | | 3/1998 | Calabria et al. | 264/134 |
| 5,779,561 | A | | 7/1998 | Sullivan et al. | 473/373 |
| 5,792,008 | A | | 8/1998 | Kakiuchi et al. | 473/354 |
| 5,885,172 | A | * | 3/1999 | Hebert et al. | 473/354 |
| 5,908,358 | A | | 6/1999 | Wu | 473/378 |
| 5,908,699 | A | | 6/1999 | Kim | 428/408 |
| 5,929,189 | A | | 7/1999 | Ichikawa et al. | 528/76 |
| 5,977,264 | A | | 11/1999 | Ichikawa et al. | 525/329.9 |
| 6,180,040 | B1 | | 1/2001 | Ladd et al. | 264/248 |
| 6,180,722 | B1 | | 1/2001 | Dalton et al. | 525/193 |
| 6,231,460 | B1 | | 5/2001 | Higuchi et al. | 473/374 |
| 6,267,692 | B1 | | 7/2001 | Higuchi et al. | 473/365 |
| 6,476,176 | B1 | * | 11/2002 | Wu | 528/76 |
| 6,506,851 | B2 | * | 1/2003 | Wu | 525/415 |
| 2003/0203771 | A1 | * | 10/2003 | Rosenberg et al. | 473/371 |
| 2003/0236382 | A1 | * | 12/2003 | Wu | 528/76 |

* cited by examiner

*Primary Examiner*—David J. Buttner
(74) *Attorney, Agent, or Firm*—Swidler Berlin Shereff Friedman, LLP

(57) ABSTRACT

A golf ball comprising a layer including a saturated polyurethane composition formed of a saturated prepolymer and a saturated curing agent, wherein the layer may be casted as an outer cover, formed as an intermediate layer, or both.

18 Claims, 3 Drawing Sheets

GOLF BALL COMPRISING SATURATED POLYURETHANES AND METHODS OF MAKING THE SAME

CROSS-REFERENCE TO RELATED APPLICATIONS

This application is a continuation-in-part of U.S. patent application Ser. No. 09/466,434, filed Dec. 17, 1999, now U.S. Pat. No. 6,476,176, the entire disclosure of which is incorporated by reference herein.

FIELD OF THE INVENTION

The invention relates to golfs balls and, more particularly, to golf balls having covers and intermediate layers that include a saturated castable polyurethane, and methods for making same. Preferably, the cover of the golf ball is formed from saturated castable polyurethane to produce an ultraviolet stable cover.

BACKGROUND OF THE INVENTION

Golf ball covers are formed from a variety of materials, including balata and ionomer resins. Balata is a natural or synthetic trans-polyisoprene rubber. Balata covered balls are favored by more highly skilled golfers because the softness of the cover allows the player to achieve spin rates sufficient to more precisely control ball direction and distance, particularly on shorter shots.

However, balata covered balls are easily damaged, and thus lack the durability required by the average golfer. Accordingly, alternative cover compositions have been developed in an attempt to provide balls with spin rates and a feel approaching those of balata covered balls, while also providing a golf ball with a higher durability and overall distance.

Ionomer resins have, to a large extent, replaced balata as a cover material. Chemically, ionomer resins are a copolymer of an olefin and an $\alpha$, $\beta$-ethylenically-unsaturated carboxylic acid having 10 to 90 percent of the carboxylic acid groups neutralized by a metal ion, as disclosed in U.S. Pat. No. 3,264,272. Commercially available ionomer resins include, for example, copolymers of ethylene and methacrylic or acrylic acid, neutralized with metal salts. Examples of commercially available ionomer resins include, but are not limited to, SURLYN® from DuPont de Nemours and Company, and ESCOR® and IOTEK® from Exxon Corporation. These ionomer resins are distinguished by the type of metal ion, the amount of acid, and the degree of neutralization.

U.S. Pat. Nos. 3,454,280, 3,819,768, 4,323,247, 4,526,375, 4,884,814, and 4,911,451 all relate to the use of SURLYN®-type compositions in golf ball covers. However, while SURLYN® covered golf balls, as described in the preceding patent, possess virtually cut-proof covers, the spin and feel are inferior compared to balata covered balls.

Polyurethanes have also been recognized as useful materials for golf ball covers since about 1960. U.S. Pat. No. 3,147,324 is directed to a method of making a golf ball having a polyurethane cover. The curing agents disclosed are diamines, polyols, or air moisture. The resulting golf balls are durable, while at the same time maintaining the "feel" of a balata ball.

Since 1960, various companies have investigated the usefulness of polyurethane as a golf ball cover material. U.S. Pat. No. 4,123,061 teaches a golf ball made from a polyurethane prepolymer of polyether and a curing agent, such as a trifunctional polyol, a tetrafunctional polyol, or a diamine. U.S. Pat. No. 5,334,673 discloses the use of two categories of polyurethane available on the market, i.e., thermoset and thermoplastic polyurethanes, for forming golf ball covers and, in particular, thermoset polyurethane covered golf balls made from a composition of polyurethane prepolymer and a slow-reacting amine curing agent, and/or a difunctional glycol.

The first commercially successful polyurethane covered golf ball was the Titleist's Professional golf ball in 1993. The principal reason for the delay in bringing polurethane composition golf ball covers on the market was that it was a daunting engineering task to apply a covering of polyurethane compositon to a golf cire to form a golf ball cover having uniform thickness.

In particular, the difficulty resided in centering a golf ball core in an amount of polyurethane that was sufficiently cured to keep the core centered while at the same time being insufficiently cured so that the cover material could be molded around the core. Resolution of this problem thus enabled production of the aforesaid Professional polyurethane covered golf ball to commence in 1993.

Unlike SURLYN® covered golf balls, polyurethane golf ball covers can be formulated to possess the soft "feel" of balata covered golf balls. However, golf ball covers made from polyurethane have not, to date, fully matched SURLYN® golf balls with respect to resilience or the rebound of the golf ball cover, which is a function of the initial velocity of a golf ball after impact with a golf club.

Furthermore, because the polyurethanes used to make the covers of such golf balls contain an aromatic component, e.g., aromatic diisocyanate, polyol, or polyamine, they are susceptible to discoloration upon exposure to light, particularly ultraviolet (UV) light. To slow down the discoloration, light and UV stabilizers, e.g., Tinuvin 770, 765, and 328 are added to these aromatic polymeric materials. However, to further ensure that the covers formed from aromatic polyurethanes do not appear discolored, the covers are painted with white paint and then covered with a clear coat to maintain the white color of the golf ball. The application of a uniform white pigmented coat to the dimpled surface of the golf ball is a difficult process that adds time and costs to the manufacture of a golf ball. Thus, there remains a need for polyurethane materials that do not discolor and that are suitable for forming a golf ball.

SUMMARY OF THE INVENTION

The invention is directed to a golf ball having at least one layer, formed of a saturated polyurethane. The term "saturated," as used herein, refers to polyurethanes having saturated aliphatic and alicyclic polymer backbones, i.e., with no double bonds. In particular, the invention relates to a golf ball having at least one layer, such layer being formed of a saturated polyurethane, which is substantially free of unsaturated carbon-carbon bonds or aromatic groups. In this regard, the components used in forming the saturated polyurethanes, as used in the invention, should be substantially free of unsaturated carbon-carbon bonds or aromatic groups. Thus, the saturated polyurethane should be formed of saturated polyols, saturated diisocyanates, and saturated curing agents.

Preferably, the saturated polyurethanes used in forming the golf balls of the present invention can be formed in accordance with the teachings described in U.S. Pat. Nos. 5,334,673, described above, and 5,484,870. U.S. Pat. No. 5,484,870 describes polyurea compositions, including golf balls employing covers formed of such polyurea compositions, including the reaction product of an organic isocyanate and an organic amine, each having at least two functional groups.

The use of such polyurethanes in the golf ball cover obviates the need to paint the golf ball with white paint prior to applying a clear topcoat to the ball. Unlike polyurethanes that contain aromatic groups or moieties, the saturated polyurethanes used in forming the golf balls of the present invention do not discolor upon exposure, especially related or extended exposure, to light. Also, by eliminating at least one coating step, the manufacturer realizes economic benefits in terms of reduced process times and consequent improved labor efficiency. Further, significant reduction in volatile organic compound ("VOC") are a typical constituent of the paint used on golf balls. Therefore, the use of saturated polyurethanes to form white covered golf balls offer significant environmental, as well as cost, benefits.

If desired, although, as noted above, it is not necessary to paint the golf balls of the invention, the saturated polyurethanes used in forming the golf balls of the invention may be used in golf balls that are painted white. The value of such balls may be enhanced due to the enhanced color stability provided by the saturated polyurethanes as the surface paint is removed from the ball during the course of play. Such golf balls will not demonstrate the discoloration often observed in golf ball covers constructed of aromatic polyurethanes.

While saturated polyurethanes will generally be used in forming some or all of the cover of the golf ball of the invention, they may also or alternatively include one or more intermediate layer(s) located between the cover and the core. The saturated polyurethane may include anywhere from about 1 to about 100 percent by weight of the intermediate layer(s) and/or the cover of the golf ball.

The invention includes one-piece golf balls including a saturated polyurethane, as well as two-piece and multi-component balls, e.g., three-piece, golf balls including at least one cover layer and a core, wherein at least one cover layer includes at least one saturated polyurethane, as well as multi-component golf balls including cores or covers having two or more layers, wherein at least one such layer(s) is formed of at least one saturated polyurethane.

More particularly, the present invention is directed, in a first embodiment, towards a golf ball including at least a cover and at least one core layer wherein the cover is formed from a composition including at least one saturated polyurethane.

The present invention is further directed in a second embodiment towards a golf ball including a cover, a core and at least one intermediate layer interposed between the cover and an outermost core layer, wherein the intermediate layer is formed from a composition including at least one saturated polyurethane.

The present invention is yet further directed in a third embodiment towards a golf ball including a cover, a core, and at least one intermediate layer interposed between the cover and the core, wherein the outermost cover layer and at least one intermediate layer are both formed from a composition including at least one saturated polyurethane.

In the golf ball cover embodiment of the present invention, the saturated polyurethane preferably includes from about 1 to about 100 weight percent of the cover, with the remainder of the cover, if any, including one or more compatible, resilient polymers usch as would be known to one of ordinary skill in the art.

The present invention is also directed to a golf ball including at least one light stable cover layer formed from a composition comprising at least one castable reactive polyurethane liquid material formed from a saturated polyurethane prepolymer and a saturated curing agent, wherein the saturated polyurethane prepolymer comprises at least one saturated diisocyanate and at least one saturated polyol.

In one embodiment, the saturated diisocyanate is selected from the group consisting of ethylene diisocyanate; propylene-1,2-diisocyanate; tetramethylene diisocyanate; tetramethylene-1,4-diisocyanate; 1,6-hexamethylene-diisocyanate; octamethylene diisocyanate; decamethylene diisocyanate; 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,2-diisocyanate; cyclohexane-1,3-diisocyanate; cyclohexane-1,4-diisocyanate; methyl-cyclohexylene diisocyanate; 2,4-methylcyclohexane diisocyanate; 2,6-methylcyclohexane diisocyanate; 4,4'-dicyclohexyl diisocyanate; 2,4'-dicyclohexyl diisocyanate; 1,3,5-cyclohexane triisocyanate; isocyanatomethylcyclohexane isocyanate; 1-isocyanato-3,3,5-trimethyl-5-isocyanatomethylcyclohexane; isocyanatoethylcyclohexane isocyanate; bis(isocyanatomethyl)-cyclohexane diisocyanate; 4,4'-bis(isocyanatomethyl) dicyclohexane; 2,4'-bis(isocyanatomethyl) dicyclohexane; isophoronediisocyanate; triisocyanate of HDI; triisocyanate of 2,2,4-trimethyl-1,6-hexane diisocyanate; 4,4'-dicyclohexylmethane diisocyanate; 2,4-hexahydrotoluene diisocyanate; 2,6-hexahydrotoluene diisocyanate; aromatic aliphatic isocyanate; meta-tetramethylxylene diisocyanate; para-tetramethylxylene diisocyanate; trimerized isocyanurate of any polyisocyanate; dimerized uretdione of any polyisocyanate; modified polyisocyanate; and mixtures thereof. In another embodiment, the saturated diisocyanate is selected from the group consisting of isophoronediisocyanate, 4,4'-dicyclohexylmethane diisocyanate, 1,6-hexamethylene diisocyanate, or a combination thereof.

The saturated polyol is preferably selected from the group consisting of saturated polyether polyols, saturated polycaprolactone polyols, saturated polyester polyols, saturated polycarbonate polyols, saturated hydrocarbon polyols, aliphatic polyols, and mixtures thereof.

In one embodiment, the saturated polyether polyols are selected from the group consisting of polytetramethylene ether glycol, PTG-L, poly(oxyethylene)glycol, poly (oxypropylene)glycol, poly(ethylene oxide capped oxypropylene)glycol, and mixtures thereof.

In another embodiment, the saturated polycaprolactone polyols are selected from the group consisting of diethylene glycol initiated polycaprolactones, propylene glycol initiated polycaprolactones, 1,4-butanediol initiated polycaprolactones, trimethylol propane initiated polycaprolactones, neopentyl glycol initiated polycaprolactones, 1,6-hexanediol initiated polycaprolactones, polytetramethylene ether glycol (PTMEG) initiated polycaprolactones, and mixtures thereof.

The saturated polyester polyols may be selected from group consisting of polyethylene adipate glycols, polyethylene propylene adipate glycols, polybutylene adipate glycols, polyethylene butylene adipate glycols, polyhexamethylene adipate glycols, polyhexamethylene butylene adipate glycols, and mixtures thereof.

In yet another embodiment, the saturated hydrocarbon polyols are selected from the group consisting of hydroxy-terminated liquid isoprene rubber, hydroxy-terminated polybutadiene polyols, and mixtures thereof, and the aliphatic polyols are selected from the group consisting of glycerols, castor oil, saturated hydroxy-terminated polybutadienes, saturated hydroxy-terminated hydrocarbon polyols, Kraton polyols, acrylic polyols, acid functionalized polyols based on a carboxylic, sulfonic, or phosphoric acid group, dimer alcohols converted from the saturated dimerized fatty acid, and mixtures thereof.

The saturated curing agent may be selected from the group consisting of hydroxy-terminated curing agents, amine-terminated curing agents, and mixture thereof. In one embodiment, the hydroxy-terminated curing agents are selected from the group consisting of ethylene glycol; diethylene glycol; polyethylene glycol; propylene glycol; 2-methyl-1,3-propanediol; 2,-methyl-1,4-butanediol; dipropylene glycol; polypropylene glycol; 1,2-butanediol; 1,3-butanediol; 1,4-butanediol; 2,3-butanediol; 2,3-dimethyl-2,3-butanediol; trimethylolpropane; cyclohexyldimethylol; triisopropanolamine; tetra-(2-hydroxypropyl)-ethylene diamine; diethylene glycol di-(aminopropyl)ether; 1,5-pentanediol; 1,6-hexanediol; 1,3-bis-(2-hydroxyethoxy) cyclohexane; 1,4-cyclohexyldimethylol; 1,3-bis-[2-(2-hydroxyethoxyethoxy]cyclohexane; 1,3-bis-{2-[2-(2-hydroxyethoxy)ethoxy]ethoxy}cyclohexane; trimethylolpropane; polytetramethylene ether glycol, preferably with a molecular weight from about 250 to about 3900; and mixtures thereof.

The amine-terminated curing agents may be selected from the group consisting of ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 1,4-cyclohexane-bis-(methylamine); 1,3-cyclohexane-bis-(methylamine); diethylene glycol di-(aminopropyl)ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; imido-bis-propylamine; monoethanolamine, diethanolamine; triethanolamine; monoisopropanolamine, diisopropanolamine; isophoronediamine; and mixtures thereof.

The castable reactive polyurethane liquid material may further include a catalyst selected from the group consisting of a bismuth catalyst, an oleic acid, triethylenediamine, di-butyltin dilaurate, acetic acid, and mixtures thereof.

In one embodiment, the cover layer has a difference in yellowness index of about 12 or less after 5 days of ultraviolet light exposure. In another embodiment, the cover layer has a difference in b chroma dimension of about 6 or less after 5 days of ultraviolet light exposure.

The present invention is further directed to a golf ball including a core, a layer disposed about the core forming a center, and a cover cast onto the center, wherein the cover comprises a saturated castable reactive liquid polyurethane material comprising a saturated diisocyanate, a saturated polyol, and at least one of a saturated hydroxy-terminated curing agent, a saturated amine-terminated curing agent, or a mixture thereof. The layer disposed about the core may include a saturated polyurethane composition.

In one embodiment, the cover has a thickness of about 0.02 inches to about 0.35 inches. In another embodiment, the layer disposed about the core has a thickness of about 0.02 inches or greater.

The present invention is also directed to a method of forming a golf ball includes the steps of: providing a golf ball center; mixing of a saturated polyurethane prepolymer and at least one saturated curing agent to form a castable reactive polyurethane liquid material; filling a first set of mold halves with a first amount of the material; lowering the center into the first set of mold halves after a first predetermined time, preferably about about 40 seconds to about 80 seconds, wherein the center is held by vacuum for a second predetermined time, and wherein the second predetermined time is sufficient for complete exothermic reaction of the first amount of material, preferably about 4 seconds to about 12 seconds; releasing the center from the vacuum providing a partially covered center; filling a second set of mold halves with a second amount of the material, wherein the first and second amounts are substantially similar, and wherein an exothermic reaction of the second amount commences; and mating the second set of mold halves with the partially covered center, wherein the exothermic reaction of the second amount concludes.

In one embodiment, the saturated polyurethane prepolymer includes at least one saturated diisocyanate and at least one saturated polyol. In another embodiment, the step of mixing a saturated polyurethane prepolymer and at least one saturated curing agent further includes mixing at least one catalyst.

The step of mixing a saturated polyurethane prepolymer and at least one saturated curing agent may further includes mixing at least one light stabilizer.

In one embodiment, the step of providing a golf ball center includes the steps of providing a golf ball core and forming a layer disposed about the golf ball core. In another embodiment, the step of forming a layer includes the steps of mixing a saturated polyurethane prepolymer and at least one saturated curing agent to form a saturated polyurethane composition and forming the saturated polyurethane composition about the core.

BRIEF DESCRIPTION OF THE DRAWINGS

Further features and advantages of the invention can be ascertained from the following detailed description that is provided in connection with the drawing(s) described below.

DETAILED DESCRIPTION OF THE INVENTION

Figure 1:
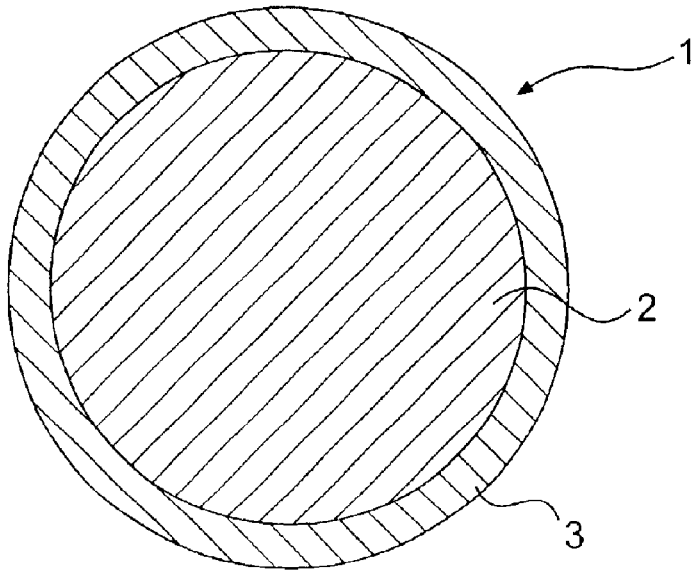
FIG. 1 is a cross-sectional view of a two-piece golf ball wherein the cover is formed from a composition including at least one saturated polyurethane.

Broadly, the present invention contemplates a golf ball including a saturated polyurethane in a variety of golf ball constructions, i.e., one-piece, two-piece, or multilayer balls.

The ball may be a one-piece ball formed from a homogeneous mass consisting entirely of such materials, or including blends of conventional golf ball cover materials, such as those discussed below, with a saturated polyurethane. One-piece balls in accordance with the present invention are quite durable, but do not provide the distance of a multi-layer golf ball because of the high spin and low velocity characteristics of the homogeneous mass.

As used herein, the term "multilayer" refers to golf balls having at least two layers, which includes wound balls and balls with multiple core, intermediate, and cover layers. A "cover" or a "core" as these terms are used herein includes a structure having either a single layer or one with two or more layers.

As used herein, a core described as including a single layer means a unitary or "one-piece" core. The "layer" thus includes the entire core from the center of the core to its outer periphery. A core, whether formed from a single layer or from two or more layers, may serve as a center for a wound ball. The golf balls of the invention may have a solid, hollow, or fluid-filled center. For example, the core of the golf ball may include a conventional center surrounded by an intermediate or outer core layer disposed between the center and the inner cover layer. The core may also include a solid or liquid filled center around which many yards of a tensioned elastomeric material are wound.

An intermediate layer may be incorporated, for example, with a single layer or multilayer cover, with a single layer or multilayer core, with both a single layer cover and core, or with both a multilayer cover and a multilayer core. A layer may additionally be composed of a tensioned elastomeric material, i.e., known as a wound layer. Intermediate layers of the type described above are sometimes referred to in the art, and, thus, herein as well, as an inner cover layer, as an outer core layer, or as a mantle layer. As with the core, the intermediate layer may also include a plurality of layers.

Likewise, the cover may include a plurality of layers, e.g., an inner cover layer disposed about a golf ball center and an outer cover layer formed thereon. Any of the core layers, intermediate layer, or cover layers may be formed of saturated polyurethane.

Saturated Polyurethanes

There are two main categories of castable polyurethanes available on the market, i.e., thermoset and thermoplastic polyurethanes. Thermoplastic polyurethanes are linear polymers and are typically formed from the reaction of a diisocyanate and a polyol cured with a diol or secondary diamine. Thermoset polyurethanes, on the other hand, are cross-linked polymers and are typically produced from the reaction of a diisocyanate and a polyol cured with a primary diamine or polyfunctional glycol. The saturated polyurethanes used to form the golf balls of the present invention may be selected from among both castable thermoset and thermoplastic polyurethanes.

The saturated polyurethanes of the present invention are substantially free of aromatic groups or moieties. Saturated polyurethanes suitable for use in the invention are a product of a reaction between at least one saturated polyurethane prepolymer and at least one saturated curing agent. The polyurethane prepolymer is a product formed by a reaction between at least one saturated polyol and at least one saturated diisocyanate. As is well known in the art, a catalyst may be employed to promote the reaction between the curing agent and the isocyanate and polyol.

Saturated isocyanates for use with the present invention include aliphatic, cycloaliphatic, araliphatic, derivatives thereof, and combinations of these compounds having two or more isocyanate (NCO) groups per molecule. The isocyanates may be organic, modified organic, organic polyisocyanate-terminated prepolymers, low free isocyanates, and mixtures thereof. The isocyanate-containing reactable component may also include any isocyanate-functional monomer, dimer, trimer, or multimeric adduct thereof, prepolymer, quasi-prepolymer, or mixtures thereof. Isocyanate-functional compounds may include monoisocyanates or polyisocyanates that include any isocyanate functionality of two or more.

Suitable isocyanate-containing components include diisocyanates having the generic structure: O═C═N—R—N═C═O, where R is preferably a cyclic or linear or branched hydrocarbon moiety containing from about 1 to 20 carbon atoms. The diisocyanate may also contain one or more cyclic groups. When multiple cyclic groups are present, linear and/or branched hydrocarbons containing from about 1 to 10 carbon atoms can be present as spacers between the cyclic groups. In some cases, the cyclic group(s) may be substituted at the 2-, 3-, and/or 4- positions, respectively. Substituted groups may include, but are not limited to, halogens, primary, secondary, or tertiary hydrocarbon groups, or a mixture thereof.

Examples of saturated diisocyanates that can be used with the present invention include, but are not limited to, ethylene diisocyanate; propylene-1,2-diisocyanate; tetramethylene diisocyanate; tetramethylene-1,4-diisocyanate; 1,6-hexamethylene-diisocyanate (HDI); octamethylene diisocyanate; decamethylene diisocyanate; 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,2-diisocyanate; cyclohexane-1,3-diisocyanate; cyclohexane-1,4-diisocyanate; methyl-cyclohexylene diisocyanate (HTDI); 2,4-methylcyclohexane diisocyanate; 2,6-methylcyclohexane diisocyanate; 4,4'-dicyclohexyl diisocyanate; 2,4'-dicyclohexyl diisocyanate; 1,3,5-cyclohexane triisocyanate; isocyanatomethylcyclohexane isocyanate; 1-isocyanato-3,3,5-trimethyl-5-isocyanatomethylcyclohexane; isocyanatoethylcyclohexane isocyanate; bis (isocyanatomethyl)-cyclohexane diisocyanate; 4,4'-bis (isocyanatomethyl)dicyclohexane; 2,4'-bis (isocyanatomethyl) dicyclohexane; isophoronediisocyanate (IPDI); triisocyanate of HDI; triisocyanate of 2,2,4-trimethyl-1,6-hexane diisocyanate (TMDI); 4,4'-dicyclohexylmethane diisocyanate ($H_{12}$MDI); 2,4-hexahydrotoluene diisocyanate; 2,6-hexahydrotoluene diisocyanate; aromatic aliphatic isocyanate, such as 1,2-, 1,3-, and 1,4-xylene diisocyanate; meta-tetramethylxylene diisocyanate (m-TMXDI); para-tetramethylxylene diisocyanate (p-TMXDI); trimerized isocyanurate of any polyisocyanate, such as isocyanurate of toluene diisocyanate, trimer of diphenylmethane diisocyanate, trimer of tetramethylxylene diisocyanate, isocyanurate of hexamethylene diisocyanate, and mixtures thereof; dimerized uretdione of any polyisocyanate, such as uretdione of toluene diisocyanate, uretdione of hexamethylene diisocyanate, and mixtures thereof; modified polyisocyanate derived from the above isocyanates and polyisocyanates; and mixtures thereof. In one embodiment, the saturated diisocyanates is isophoronediisocyanate (IPDI), 4,4'-dicyclohexylmethane diisocyanate ($H_{12}$MDI), 1,6-hexamethylene diisocyanate (HDI), or a combination thereof.

Any saturated polyol available to one of ordinary skill in the art is suitable for use according to the invention. Exemplary polyols include, but are not limited to, polyether polyols, polycaprolactone polyols, polyester polyols, polycarbonate polyols, hydrocarbon polyols, and mixtures thereof.

Suitable saturated polyether polyols for use in the present invention include, but are not limited to, polytetramethylene ether glycol (PTMEG); PTG-L; poly(oxyethylene)glycol; poly(oxypropylene) glycol; poly(ethylene oxide capped oxypropylene)glycol; and mixtures thereof.

Saturated polycaprolactone polyols include, but not limited to, diethylene glycol initiated polycaprolactone; propylene glycol initiated polycaprolactone; 1,4-butanediol initiated polycaprolactone; trimethylol propane initiated polycaprolactone; neopentyl glycol initiated polycaprolactone; 1,6-hexanediol initiated polycaprolactone; polytetramethylene ether glycol (PTMEG) initiated polycaprolactone; and mixtures thereof.

Suitable saturated polyester polyols include, but not limited to, polyethylene adipate glycol; polyethylene propylene adipate glycol; polybutylene adipate glycol; polyethylene butylene adipate glycol; polyhexamethylene adipate glycol; polyhexamethylene butylene adipate glycol; and mixtures thereof. An example of a polycarbonate polyol that may be used with the present invention includes, but is not limited to, poly(hexamethylene carbonate)glycol.

Hydrocarbon polyols include, but not limited to, hydroxy-terminated liquid isoprene rubber (LIR), hydroxy-terminated polybutadiene polyol, saturated hydroxy-terminated hydrocarbon polyols, and mixtures thereof.

Other aliphatic polyols that may be used to form the prepolymer of the invention include, but not limited to, glycerols; castor oil and its derivatives; Kraton polyols; acrylic polyols; acid functionalized polyols based on a carboxylic, sulfonic, or phosphoric acid group; dimer alcohols converted from the saturated dimerized fatty acid; and mixtures thereof.

The polyurethane composition can be formed with a blend or mixture of curing agents. Saturated curatives for use with the present invention include, but are not limited to, hydroxy terminated curing agents, amine-terminated curing agents, and mixtures thereof. If desired, however, the polyurethane composition may be formed with a single curing agent. As discussed, the polyurethanes prepolymers cured with a diol or secondary diamine with 1:1 stoichiometry are thermoplastic in nature. Thermoset polyurethanes, on the other hand, are generally produced from a prepolymer cured with a primary diamine or polyfunctional glycol.

Suitable hydroxy-terminated curing agents include, but are not limited to, ethylene glycol; diethylene glycol; polyethylene glycol; propylene glycol; 2-methyl-1,3-propanediol; 2-methyl-1,4-butanediol; dipropylene glycol; polypropylene glycol; 1,2-butanediol; 1,3-butanediol; 1,4-butanediol; 2,3-butanediol; 2,3-dimethyl-2,3-butanediol; trimethylolpropane; cyclohexyldimethylol; triisopropanolamine; tetra-(2-hydroxypropyl)-ethylene diamine; diethylene glycol di-(aminopropyl)ether; 1,5-pentanediol; 1,6-hexanediol; 1,3-bis-(2-hydroxyethoxy)cyclohexane; 1,4-cyclohexyldimethylol; 1,3-bis-[2-(2-hydroxyethoxy) ethoxy]cyclohexane; 1,3-bis-{2-[2-(2-hydroxyethoxy) ethoxy]ethoxy}cyclohexane; trimethylolpropane; polytetramethylene ether glycol having molecular weight ranging from about 250 to about 3900; and mixtures thereof. In one embodiment, the hydroxy-terminated curing agent has a molecular weight of at least 50. In another embodiment, the molecular weight of the hydroxy-terminated curing agent is about 2000 or less. It should be understood that molecular weight, as used herein, is the absolute weight average molecular weight and would be understood as such by one of ordinary skill in the art.

Suitable amine-terminated curing agents include, but are not limited to, ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 1,4-cyclohexane-bis-(methylamine); 1,3-cyclohexane-bis-(methylamine); diethylene glycol di-(aminopropyl)ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; imido-bis-propylamine; monoethanolamine, diethanolamine; triethanolamine; monoisopropanolamine, diisopropanolamine; triisopropanolamine; isophoronediamine; and mixtures thereof. In one embodiment, the amine-curing agent has molecular weights of about 64 or greater. In another embodiment, the molecular weight of the amine-curing agent is about 2000 or less.

A catalyst may be employed to promote the reaction between the curing agent and the prepolymer. Suitable catalysts include, but are not limited to bismuth catalyst, oleic acid, triethylenediamine and di-butyltin dilaurate (DBACO®-33LV and DBACO®-T12 manufactured by Air Products and Chemicals, Inc.), acetic acid, and mixtures thereof. In one embodiment, the catalyst is di-butyltin dilaurate.

Saturated Polyurethane Covers

In one embodiment of the present invention, saturated polyurethanes are used to form cover layers, preferably the outer cover layer, and may be selected from among both castable thermoset and thermoplastic polyurethanes. In this embodiment, the saturated polyurethanes are substantially free of aromatic groups or moieties. Thus, saturated diisocyanates which can be used include, but are not limited to, ethylene diisocyanate; propylene-1,2-diisocyanate; tetramethylene-1,4-diisocyanate; 1,6-hexamethylene-diisocyanate ("HDI"); 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; isophorone diisocyanate ("IPDI"); methyl cyclohexylene diisocyanate; triisocyanate of HDI; triisocyanate of 2,2,4-trimethyl-1,6-hexane diisocyanate ("TMDI"). The most preferred saturated diisocyanates are 4,4'-dicyclohexylmethane diisocyanate ("$H_{12}$MDI") and isophorone diisocyanate ("IPDI").

When using saturated polyurethanes to form cover layers, the saturated polyols that are appropriate for use in this invention include, but are not limited to, polyether polyols such as polytetramethylene ether glycol and poly (oxypropylene) glycol. Suitable saturated polyester polyols include polyethylene adipate glycol, polyethylene propylene adipate glycol, polybutylene adipate glycol, polycarbonate polyol and ethylene oxide-capped polyoxypropylene diols. Saturated polycaprolactone polyols which are useful in the invention include diethylene glycol initiated polycaprolactone, 1,4-butanediol initiated polycaprolactone, 1,6-hexanediol initiated polycaprolactone; trimethylol propane initiated polycaprolactone, neopentyl glycol initiated polycaprolactone, PTMEG-initiated polycaprolactone. The most preferred saturated polyols are PTMEG and PTMEG-initiated polycaprolactone.

When using saturated polyurethanes to form at least one of the cover layers of the golf ball of the present invention, suitable saturated curatives include 1,4-butanediol, ethylene glycol, diethylene glycol, polytetramethylene ether glycol, propylene glycol; trimethanolpropane; tetra-(2-hydroxypropyl)-ethylenediamine; isomers and mixtures of isomers of cyclohexyldimethylol, isomers and mixtures of isomers of cyclohexane bis(methylamine); triisopropanolamine, ethylene diamine, diethylene triamine, triethylene tetramine, tetraethylene pentamine, 4,4'-dicyclohexylmethane diamine, 2,2,4-trimethyl-1,6-hexanediamine; 2,4,4-trimethyl-1,6-hexanediamine; diethyleneglycol di-(aminopropyl)ether; 4,4'-bis-(sec-butylamino)-dicyclohexylmethane; 1,2-bis-(sec-butylamino)cyclohexane; 1,4-bis-(sec-butylamino) cyclohexane; isophorone diamine, hexamethylene diamine, propylene diamine, 1-methyl-2,4-cyclohexyl diamine, 1-methyl-2,6-cyclohexyl diamine, 1,3-diaminopropane, dimethylamino propylamine, diethylamino proplyamine, imid-bis-propylamine, isomers and mixtures of isomers of diaminocyclohexame, monoethanolamine, diethanolamine, triethanolamine, monoisopropanolamine, and diisopropanolamine. The most preferred saturated curatives are 1,4-butanediol, 1,4-cyclohexyldimethylol and 4,4'-bis-(sec-butylamino)-dicyclohexylmethane.

Suitable catalysts include, but are not limited to bismuth catalyst, oleic acid, triethylenediamine (DABCO®-33LV), di-butyltin dilaurate (DABCO®-T12) and acetic acid. The most preferred catalyst is di-butyltin dilaurate (DABCO®-T12). DABCO® materials are manufactured by Air Products and Chemicals, Inc.

Composition Blends

As discussed, polyurethane prepolymers are produced by combining at least one polyol, such as a polyether, polycaprolactone, polycarbonate or a polyester, and at least one isocyanate. Castable thermosetting polyurethanes are obtained by curing at least one polyurethane prepolymer with a curing agent selected from a primary diamine, triol or tetraol. Castable thermoplastic polyurethanes are obtained by curing at least one polyurethane prepolymer with a diol or secondary diamine curing agent at 1:1 stoichiometry.

It is well known in the art that if the saturated polyurethane materials are to be blended with other thermoplastics, care must be taken in the formulation process so as to produce an end product that is thermoplastic in nature. Preferably, the cover and/or intermediate layer compositions include from about 1 percent to about 100 percent of saturated polyurethane. In one embodiment, the cover composition and/or the intermediate layer composition includes about 10 percent to about 75 percent saturated polyurethane. The saturated polyurethane composition may be a blend, such that about 90 percent to about 10 percent, more preferably from about 90 percent to about 25 percent of the cover and/or the intermediate layer composition includes one or more other polymers and/or other materials as described below.

Such polymers include, but are not limited to polyurethane/polyurea ionomers, polyurethanes or polyureas, epoxy resins, polyethylenes, polyamides and polyesters, polycarbonates, polyacrylin, and mixtures thereof Unless otherwise stated herein, all percentages are given in percent by weight of the total composition of the golf ball layer in question. For example, the cover and/or intermediate layer may be formed from a blend of at least one saturated polyurethane and at least one thermoplastic or thermoset, ionic or non-ionic, polyurethane or polyurea, cationic urethane ionomers and urethane epoxies, and blends thereof. Examples of suitable urethane ionomers are disclosed in U.S. Pat. No. 5,692,974, the disclosure of which is hereby incorporated by reference in its entirety. Other examples of suitable polyurethanes are described in U.S. Pat. No. 5,334,673, the entire disclosure of which is incorporated by reference herein. Examples of appropriate polyureas are discussed in U.S. Pat. No. 5,484,870 and examples of suitable polyurethanes cured with epoxy group containing curing agents are disclosed in U.S. Pat. No. 5,908,358, the disclosures of which are hereby incorporated herein by reference in their entirety.

A variety of conventional components can be added to the cover compositions of the present invention. These include, but are not limited to, white pigment such as $TiO_2$, ZnO, optical brighteners, surfactants, processing aids, foaming agents, UV stabilizers, and light stabilizers. Saturated polyurethanes are resistant to discoloration. However, they are not immune to deterioration in their mechanical properties upon weathering. Addition of UV absorbers and light stabilizers to any of the above compositions and, in particular, the polyurethane compositions, help to maintain the tensile strength, elongation, and color stability. Suitable UV absorbers and light stabilizers include TINUVIN® 328, TINUVIN® 213, TINUVIN® 765, TINUVIN® 770 and TINUVIN® 622. The preferred UV absorber is TINUVIN® 328, and the preferred light stabilizer is TINUVIN® 765. TINUVIN® products are available from Ciba-Geigy. Dyes, as well as optical brighteners and fluorescent pigments may also be included in the golf ball covers produced with polymers formed according to the present invention. Such additional ingredients may be added in any amounts that will achieve their desired purpose.

Other conventional ingredients, e.g., density-controlling fillers, ceramics, and glass spheres are well known to the person of ordinary skill in the art and may be included in cover and intermediate layer blends of the present invention in amounts effective to achieve their known purpose. Thus, an optional filler component may be chosen to impart additional density to the compositions of the invention. The selection of such filler(s) is dependent upon the type of golf ball desired, i.e., one-piece, two-piece, multi-component, or wound, as will be more fully detailed below. Generally, the filler will be inorganic, having a density of greater than 4 g/cc, and will be present in amounts between about 5 and about 65 weight percent based on the total weight of the polymer components included in the layer(s) in question. Examples of useful fillers include zinc oxide, barium sulfate, calcium oxide, calcium carbonate, and silica, as well as other known corresponding salts and oxides thereof.

Golf Ball Cores

A representative elastomer base composition for forming a golf ball core prepared in accordance with the present invention includes a base rubber, a crosslinking agent, and a filler. The base rubber typically includes natural or synthetic rubbers. A preferred base rubber is 1,4-polybutadiene having a cis-structure of at least about 40 percent. Natural rubber, polyisoprene rubber and/or styrene-butadiene rubber may be optionally added to the 1,4-polybutadiene. Crosslinking agents includes metal salts of unsaturated fatty acids, such as zinc or magnesium salts of acrylic or methacrylic acid. The filler typically includes materials such as zinc oxide, barium sulfate, silica, calcium carbonate, metal, glass spheres, and the like. The cores of the golf balls formed according to the invention may be solid or hollow, fluid-filled or semi-solid filled, one-piece or multi-component cores. The cores may also be wound with a tensioned elastomeric layer.

Golf Ball Manufacture

The saturated polyurethanes of the invention can be used to form any type of ball, i.e., one-piece, two-piece, wound, or multi-component. In particular, two-piece golf balls having a cover surrounding a core are within the scope of the present invention, as are wound golf balls, in which a fluid, semi-solid, or solid core is surrounded by a tensioned elastomeric material. The term "fluid" as used herein refers to a liquid or a gas. The term "semi-solid" as used herein refers to a paste, a gel, or the like. The term "solid cores" as used herein refers not only to one-piece cores, but also to those cores having a separate solid layer beneath the cover and above the core, as disclosed in U.S. Pat. No. 4,431,193, the entire disclosure of which is incorporated by reference herein, and other multilayer and/or non-wound cores. Any type of golf ball core can be used in the golf balls of the present invention. In one embodiment, the cores include some amount of cis-polybutadiene. The subject polymers may also be used in golf balls having multiple covers and/or multiple cores.

The core compositions of the invention may be produced by blending a mixture including polybutadiene, zinc diacrylate, and at least one saturated polyurethane. In preparing the core blends, when a set of predetermined conditions is met, i.e., time and temperature of mixing, the free radical initiator is added in an amount dependent upon the amounts and relative ratios of the starting components, all of which would be well understood by one of ordinary skill in the art. In particular, as the components are mixed, the resultant shear causes the temperature of the mixture to rise. Peroxide(s) free radical initiator(s) are blended into the mixture for crosslinking purposes in the molding process.

After completion of the mixing, the golf ball core is milled and hand prepped or extruded into pieces ("preps") suitable for molding. The milled preps are then compression molded into cores at an elevated temperature. Typically, 160° C. (320° F.) for 15 minutes is suitable for purpose. These cores can then be used to make finished balls by surrounding the cores with intermediate layer and/or cover materials.

The use of a castable reactive polyurethane material, which is generally applied in a fluid form by a process generally known in the art as "casting", makes it possible to obtain very thin outer cover layers on golf balls. Specifically, castable reactive polyurethane liquids, which react to form a urethane elastomer material, provide desirable very thin outer cover layers.

The castable reactive liquid employed to form the urethane elastomer material can be applied over the core using a variety of application techniques such as spraying, compression molding, dipping, spin coating, or flow coating methods that are well known in the art. In one embodiment, the castable reactive polyurethane material is formed over the core using a combination of casting and compression molding.

One method for forming a polyurethane cover on a golf ball core is disclosed in U.S. Pat. No. 5,733,428, the entire disclosure of which is hereby incorporated by reference. This method relates to the use of thermosetting material as the golf ball cover, wherein the cover is formed around the core by mixing and introducing the material in mold halves. Once mixed, an exothermic reaction commences and continues. It is important that the viscosity be measured over time, so that the subsequent steps of filling each mold half, introducing the core into one half and closing the mold can be properly timed for accomplishing centering of the core cover halves fusion and achieving overall uniformity. Suitble viscosity range of the curing urethane mix for introducing cores into the mold halves is determined to be approximately between about 2,000 cP and about 30,000 cP, with the preferred range of about 8,000 cP to about 15,000 cP.

To start the cover formation, mixing of the prepolymer and curative is accomplished in motorized mixer inside a mixing head by feeding through lines metered amounts of curative and prepolymer. Top preheated mold halves are filled and placed in fixture units using centering pins moving into apertures in each mold. At a later time, the cavity of a bottom mold half, or the cavities of a series of bottom mold halves, is filled with similar mixture amounts as used for the top mold halves. After the reacting materials have resided in top mold halves for about 40 to about 80 seconds, a core is lowered at a controlled speed into the gelling reacting mixture.

A ball cup holds the ball core through reduced pressure (or partial vacuum). Upon location of the coated core in the halves of the mold after gelling for about 4 to about 12 seconds, the vacuum is released allowing the core to be released. In one embodiment, the vacuum is released allowing the core to be released after about 5 seconds to 10 seconds. The mold halves, with core and solidified cover half thereon, are removed from the centering fixture unit, inverted and mated with second mold halves which, at an appropriate time earlier, have had a selected quantity of reacting polyurethane prepolymer and curing agent introduced therein to commence gelling.

Similarly, U.S. Pat. Nos. 5,006,297 and 5,334,673 both also disclose suitable molding techniques that may be utilized to apply the castable reactive liquids employed in the present invention. Further, U.S. Pat. Nos. 6,180,040 and 6,180,722 disclose methods of preparing dual core golf balls. The disclosures of these patents are hereby incorporated by reference in their entirety. However, the method of the invention is not limited to the use of these techniques; other methods known to those skilled in the art may also be employed.

The present invention can be used in forming golf balls of any desired size. "The Rules of Golf" by the USGA dictates that the size of a competition golf ball be at least 1.680 inches in diameter, but golf balls of any size can be used for leisure golf play. The preferred diameter is from about 1.680 inches to about 1.800 inches. The more preferred diameter is from about 1.680 inches to about 1.760 inches. A diameter of about 1.680 inches to about 1.740 inches is most preferred, however diameters anywhere from about 1.60 inches to about 1.95 inches can be used. Oversize golf balls with diameters above about 1.760 inches to as big as 2.75 inches are also within the scope of the invention.

Preferred embodiments of the balls of the invention are shown in FIGS. 1–5. In FIG. 1, the golf ball 1 includes a core 2 of conventional materials and a cover 3 including at least one saturated polyurethane.

Figure 2:
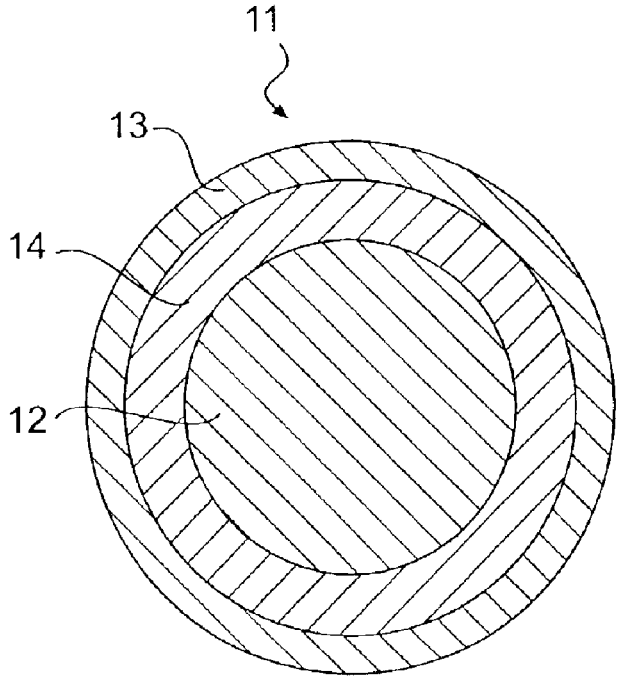
FIG. 2 is a cross-sectional view of a multi-component golf ball wherein at least one intermediate layer is formed from a composition including at least one saturated polyurethane.

FIG. 2 illustrates a multi-piece golf ball 11, including a cover 13, at least one intermediate layer 14, and a core 12. The intermediate layer includes at least one saturated polyurethane.

Figure 3:
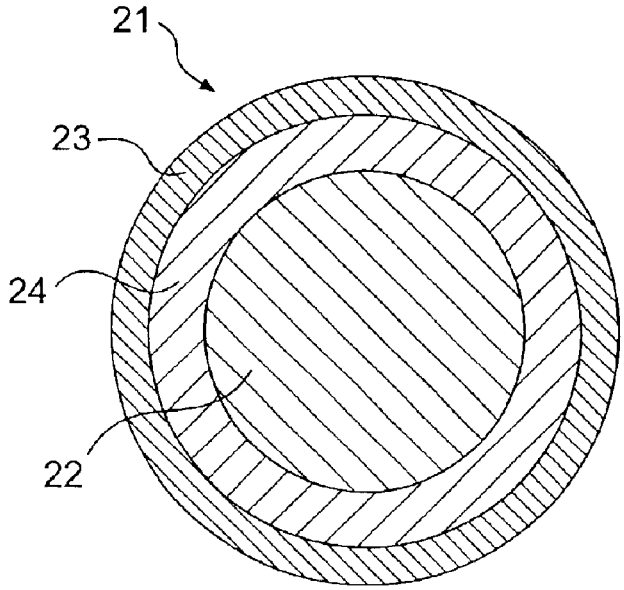
FIG. 3 is a cross-sectional view of a multi-component golf ball wherein the cover and an intermediate layer are formed from a composition including at least one saturated polyurethane.

The golf ball 21 of FIG. 3 has a core 22 made of conventional materials, and at least one intermediate layer 24 and cover 23 including at least one saturated polyurethane.

Figure 4:
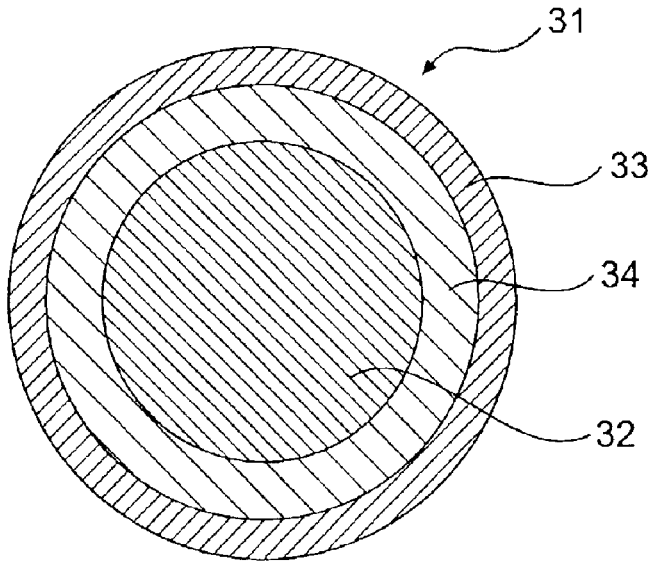
FIG. 4 is a cross-sectional view of a wound golf ball wherein the core is surrounded by a tensioned elastomeric material and the cover is formed from a composition including at least one saturated polyurethane.

The wound golf ball 31 of FIG. 4 has a core 32 made of conventional materials, an intermediate layer including a tensioned elastomeric material 34 and cover 33 including at least one saturated polyurethane.

Figure 5:
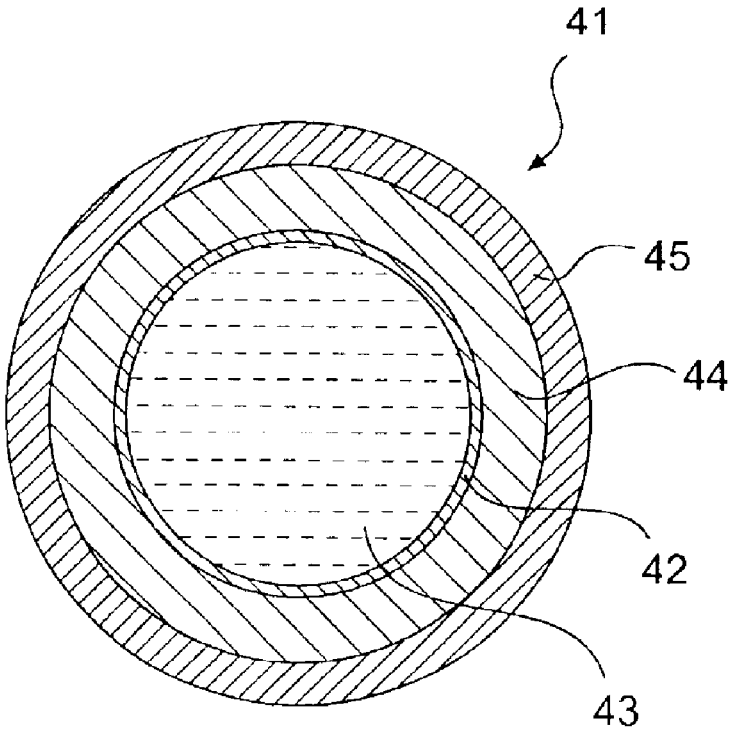
FIG. 5 is a cross-sectional view of a liquid center golf ball wherein the liquid core is surrounded by a tensioned elastomeric material and the cover is formed from a composition including at least one saturated polyurethane.

The wound, liquid center golf ball 41 of FIG. 5 has a hollow spherical core shell 42 with its hollow interior filled with a liquid 43, a thread rubber layer including a tensioned elastomeric material 44 and a cover 45 including at least one saturated polyurethane.

Golf Ball Properties

Balls formed with the saturated polyurethane compositions of the invention typically have an Atti compression of greater than about 55, preferably from about 60 to about 120. As used herein, the term "Atti compression" is defined as the deflection of an object or material relative to the deflection of a calibrated spring, as measured with an Atti Compression Gauge (commercially available from Atti Engineering Corp. of Union City, N.J.

The outer cover hardness, measured on a durometer, should be at least about 40 Shore D, and preferably about 45 to about 80 Shore D, while the hardness of an intermediate layer including the saturated polyurethane composition should be at least about 15 Shore A. In one embodiment, the cover has a hardness of about 70 Shore C or greater, preferably about 80 Shore C or greater. In another embodiment, the cover has a hardness of about 95 Shore C or less, preferably about 90 Shore C or less.

The thickness of the outer cover layer is preferably from about 0.02 inches to about 0.35 inches, while the thickness of an intermediate layer including the saturated polyurethane composition is preferably about 0.02 inches or greater. The specific gravity of a cover or intermediate layer including the saturated polyurethane composition is preferably at least about 0.7. The flexural modulus of a cover or intermediate layer including the saturated polyurethane composition is preferably at least about 500 psi. The percent dimple coverage on the surface of a golf ball of the invention is preferably at least about 60 percent, and more preferably about 70 percent or greater.

The light stability of the cover may be quantified by the difference in yellowness index ($\Delta Y1$), i.e., yellowness measured after a predetermined exposure time—yellowness before exposure. In one embodiment, the $\Delta Y1$ is about 12 or less after 5 days (120 hours) of exposure, preferably about 10 or less after 5 days of exposure, and more preferably about 8 or less after 5 days of exposure. In one embodiment, the $\Delta Y1$ is about 2 or less after 5 days of exposure. The difference in the b chroma dimension ($\Delta b^*$, yellow to blue) is also a way to quantify the light stability of the cover. In one embodiment, the $\Delta b^*$ is about 6 or less after 5 days (120 hours) of exposure, preferably about 5.5 or less after 5 days of exposure, and more preferably about 5.2 or less after 5 days of exposure. In one embodiment, the $\Delta b^*$ is about 2 or less after 5 days of exposure.

EXAMPLES

The following non-limiting examples are merely illustrative of the preferred embodiments of the present invention, and are not to be construed as limiting the invention, the scope of which is defined by the appended claims. Parts are by weight unless otherwise indicated.

Example 1

Saturated Polyurethane Golf Ball Cover

Table 1 illustrates the components used to make a first saturated polyurethane golf ball cover composition.

TABLE 1

COMPOSITION

| Chemicals | Weight (g) |
|---|---|
| IPDI Prepolymer* | 458.73 |
| 1,4-Butanediol | 42.75 |
| HCC-19584 Color Dispersion** | 17.55 |

*Prepolymer is the reaction product of isophorone diisocyanate and polytetramethylene ether glycol.
**HCC-19584 is a white-blue color dispersion manufactured by Harwick Chemical Corporation A golf ball was made having the cover formulated from the composition above following the teachings of U.S. Pat. No. 5,733,428. The physical properties and the ball performance results are listed in Table 2.

TABLE 2

PHYSICAL PROPERTIES

| Physical Properties | Present Invention |
|---|---|
| Cover Hardness | 68 |
| Weight (g) | 45.20 |
| Compression | 103 |
| Shear Resistance | Good |
| Color Stability | Comparable to SURLYN ® |

Example 2

Saturated Polyurethane Golf Ball Cover

Table 3 illustrates the components used to make a second saturated polyurethane golf ball cover composition.

TABLE 3

COMPOSITION

| Chemicals | Weight (g) |
|---|---|
| $H_{12}$MDI Prepolymer* | 458.73 |
| 1,4-Butanediol | 42.75 |
| HCC-19584 Color Dispersion** | 17.55 |

*Prepolymer is the reaction product of 4,4'-dicyclohexylmethane diisocyanate and polytetramethylene ether glycol.
**HCC-19584 is a white-blue color dispersion manufactured by Harwick Chemical Corporation A golf ball was made having the cover formulated from the composition above following the teachings of U.S. Pat. No. 5,733,428. The physical properties and the ball performance results are listed in Table 2.

TABLE 4

PHYSICAL PROPERTIES

| Physical Properties | Present Invention |
|---|---|
| Cover Hardness | 54 |
| Weight (g) | 45.58 |
| Compression | 89 |
| Shear Resistance | Good |
| Color Stability | Comparable to SURLYN ® |

The molded balls from the above composition listed in Table 2 were further subject to a QUV test as described below:

Method

ASTM G 53–88 "Standard Practice for Operating Light and Water-Exposure Apparatus (Fluorescent UV-Condensation Type) for Exposure of Nonmetallic Materials" was followed with certain modifications as described below:

Six balls of each variety under evaluation were placed in custom made golf ball holders and inserted into the sample rack of a Q-PANEL model OUV/SER Accelerated Weathering Tester manufactured by Q-Panel Lab Products of Cleveland, Ohio. The sample holders were constructed such that each ball was approximately 1.75 inches from a UVA-340 bulb, at its closest point. The weathering tester was then cycled every four hours between the following two sets of conditions (for the specified total length of time 24, 48, and 120 hours):

Condition #1: water bath temperature of about 50° C. with the UV lamps on, set and controlled at an irradiance power of 1.00 $W/m^2/nm$.

Condition #2: water bath temperature of about 40° C. with the UV lamps turned off.

Color was measured before weathering and after each time cycle using a BYK-Gardner Model TCS II sphere type Spectrophotometer equipped with a 25 mm port. A D65/10° illumination was used in the specular reflectance included mode.

The test results for the molded balls after 24 hours of UV exposure are tabulated in Table 5, wherein ΔL* equals the difference in L dimension (light to dark), Δa* equals the difference in the a chroma dimension (red to green), Δb* equals the difference in the b chroma dimension (yellow to blue), ΔC* equals the combined chroma difference (a* and b* scales), hue and saturation, ΔH* equals the total hue difference, excluding effects of saturation and luminescence, ΔE* equals the total color difference, ΔW1 equals the difference in the whiteness index, and ΔY 1 and the difference in the yellowness index.

TABLE 5

UV STABILITY DATA

| Sample | ΔL* | Δa* | Δb* | ΔC* | ΔH* | ΔE*ab | ΔW1 (E313) | ΔY1 (D1925) |
|---|---|---|---|---|---|---|---|---|
| Molded Present Invention | −0.21 | −0.30 | 1.54 | −1.26 | −0.94 | 1.58 | −9.07 | 2.99 |
| Molded Aromatic Polyurethane | −17.27 | 11.36 | 46.14 | 47.31 | 4.36 | 50.56 | −142.35 | 93.80 |
| Molded SURLYN ® | −0.39 | −0.25 | 0.91 | −0.76 | −0.55 | 1.02 | −6.19 | 1.69 |

The test results for the molded balls after 48 hours of UV exposure are illustrated in Table 6.

TABLE 6

UV STABILITY DATA

| Sample | ΔL* | Δa* | Δb* | ΔC* | ΔH* | ΔE*ab | ΔW1 (E313) | ΔY1 (D1925) |
|---|---|---|---|---|---|---|---|---|
| Molded Present Invention | −0.48 | −0.37 | 2.54 | −2.02 | −1.59 | 2.61 | −15.16 | 4.98 |
| Molded Aromatic Polyurethane | −23.46 | 15.01 | 42.75 | 45.18 | 3.44 | 51.02 | −127.75 | 98.96 |
| Molded SURLYN ® | −0.54 | −0.39 | 1.43 | −1.18 | −0.91 | 1.58 | −9.50 | 2.66 |

The test results for the molded balls after 120 hours of UV exposure are illustrated in 20 Table 7.

TABLE 7

UV STABILITY DATA

| Sample | ΔL* | Δa* | Δb* | ΔC* | ΔH* | ΔE*ab | ΔW1 (E313) | ΔY1 (D1925) |
|---|---|---|---|---|---|---|---|---|
| Molded Present Invention | −0.92 | −0.46 | 5.87 | −3.01 | −5.06 | 5.96 | −33.72 | 11.68 |
| Molded Aromatic Polyurethane | −30.06 | 16.80 | 33.37 | 37.29 | 2.11 | 47.95 | −107.12 | 94.42 |
| Molded SURLYN ® | −0.99 | −0.85 | 4.06 | −2.91 | −2.96 | 4.26 | −24.88 | 7.73 |

Example 3

$H_{12}$MDI Polyether Urethane Elastomer

A golf ball was made having the cover formulated from the composition in Table 8 including $H_{12}$MDI polyether urethane elastomer.

TABLE 8

$H_{12}$MDI POLYETHER URETHANE ELASTOMER COMPOSITION

| Chemical Components | Weight (g) |
|---|---|
| $H_{12}$MDI/PTMEG Prepolymer, 9.1% NCO | 462.64 |
| 1,4-Butanediol | 26.02 |
| S28755PST3 Color Dispersion* | 31.25 |
| Dabco ® T-12 Catalyst | 0.65 |

*S28755PST3 color dispersion is manufactured by PPG Industries.

The physical properties and the ball performance results are listed in Table 9. A control ball made with an aromatic polyurethane is also included in Table 9 for comparison purposes.

TABLE 9

| PHYSICAL PROPERTIES | | |
|---|---|---|
| Ball Properties/Ball Types | Aromatic Control | Invention |
| Nameplate Average | 1.684 | 1.683 |
| Equator Average | 1.685 | 1.683 |
| Weight Average, oz | 1.608 | 1.594 |
| Compression Average | 87 | 86 |
| Cover Hardness, Shore C | 81 | 79 |
| CoR @ 125 ft/sec | 0.810 | 0.809 |
| Impact Durability, 600 Hits | 1 failed @ 369 hits<br>1 failed @ 400 hits | no failure |
| Cold Crack Test, 5° F. | no failure | no failure |
| Light Stability | | |
| 5 Days QUV Test | | |
| ΔY1 | | 1.6 |
| Δb* | | 0.8 |
| Live Golfer Shear Test* | | |
| Damage Rank | 3 | 2 |
| Appearance Rank | 3 | 2 |

*Rating of Shear Test: Based on a scale of 1–9, 1 is the best, 9 is the worst.

Example 4

$H_{12}$MDI Polycaprolactone Urethane Elastomer

A golf ball was made having the cover formulated from the composition in Table 10 including $H_{12}$MDI polycaprolactone urethane elastomer.

TABLE 10

| $H_{12}$MDI POLYCAPROLACTONE URETHANE ELASTOMER COMPOSITION | |
|---|---|
| Chemical Components | Weight (g) |
| $H_{12}$MDI/Polycaprolactone Prepolymer, 9.1% NCO | 462.64 |
| 1,4-Butanediol | 26.02 |
| S28755PST3 Color Dispersion* | 31.25 |
| Tinuvin ® 292 HALS | 1.30 |
| Dabco ® T-12 Catalyst | 0.65 |

*S28755PST3 color dispersion is manufactured by PPG Industries.

The physical properties and the ball performance results are listed in Table 11. A control ball made with an aromatic polyurethane is also included in Table 11 for comparison purposes.

TABLE 11

| PHYSICAL PROPERTIES | | |
|---|---|---|
| Ball Properties/Ball Types | Aromatic Control | Invention |
| Nameplate Average | 1.678 | 1.683 |
| Equator Average | 1.680 | 1.683 |
| Weight Average, oz | 1.605 | 1.607 |
| Compression Average | 90 | 87 |
| Cover Hardness, Shore C | 82 | 83 |
| CoR @ 125 ft/sec | 0.811 | 0.808 |
| Impact Durability, 600 Hits | 1 failed @ 419, 488, 510, 512, 521 hits | 1 failed @ 535 hit |
| Cold Crack Test, 5° F. | no failure | no failure |
| Light Stability | 3 Hour QUV Test | 5 Days QUV Test |
| ΔY1 | 79.1 | 1.0 |
| Δb* | 40.8 | 0.5 |
| Live Golfer Shear Test* | | |
| Damage Rank | 1 | 7 |
| Appearance Rank | 1 | 7 |

*Rating of Shear Test: Based on a scale of 1–9, 1 is the best, 9 is the worst.

Example 5

$H_{12}$MDI Polyester Urethane Elastomer

A golf ball was made having the cover formulated from the composition in Table 12 including $H_{12}$MDI polyester urethane elastomer.

TABLE 12

| $H_{12}$MDI POLYESTER URETHANE ELASTOMER COMPOSITION | |
|---|---|
| Chemical Components | Weight (g) |
| $H_{12}$MDI/polyhexamethylene butylene adipate, 8.07% NCO | 521.69 |
| 1,4-Butanediol | 24.01 |
| S28755PST3 Color Dispersion* | 35.00 |
| Dabco ® T-12 Catalyst | 0.73 |

*S28755PST3 color dispersion is manufactured by PPG Industries.

The physical properties and the ball performance results are listed in Table 13. A control ball made with an aromatic polyurethane is also included in Table 13 for comparison purposes.

TABLE 13

| PHYSICAL PROPERTIES | | |
|---|---|---|
| Ball Properties/Ball Types | Aromatic Control | Invention |
| Nameplate Average | 1.684 | 1.683 |
| Equator Average | 1.683 | 1.680 |
| Weight Average, oz | 1.607 | 1.610 |
| Compression Average | 87 | 88 |
| Cover Hardness, Shore C | 81 | 84 |
| CoR @ 125 ft/sec | 0.806 | 0.803 |
| Impact Durability, 600 Hits | no failure | no failure |
| Cold Crack Test, 5° F. | no failure | no failure |
| Light Stability | 3 Hour QUV Test | 5 Days QUV Test |
| ΔY1 | 79.1 | 1.6 |
| Δb* | 40.8 | 0.8 |
| Live Golfer Shear Test* | | |
| Damage Rank | 1 | 3 |
| Appearance Rank | 1 | 2 |

*Rating of Shear Test Based on a scale of 1–9, 1 is the best, 9 is the worst.

Example 6

$H_{12}$MDI Polyether Urethane/Urea Elastomer

A golf ball was made having the cover formulated from the composition in Table 14 including $H_{12}$MDI polyether urethane/urea elastomer.

TABLE 14

| $H_{12}$MDI POLYETHER URETHANE/UREA ELASTOMER COMPOSITION | |
|---|---|
| Chemical Components | Weight (g) |
| $H_{12}$MDI/PTMEG Prepolymer, 7.9% NCO | 532.91 |
| Clearlink 1000 | 152.95 |
| HCC-19584 Color Dispersion* | 24.88 |
| Dabco ® T-12 Catalyst | 0.07 |

*HCC-19584 color dispersion is manufactured by PolyOne Corporation.

The physical properties and the ball performance results are listed in Table 15. A control ball made with an aromatic polyurethane is also included in Table 15 for comparison purposes.

TABLE 15

| PHYSICAL PROPERTIES | | |
|---|---|---|
| Ball Properties/Ball Types | Aromatic Control | Invention |
| Nameplate Average | 1.683 | 1.687 |
| Equator Average | 1.683 | 1.682 |
| Weight Average, oz | 1.608 | 1.596 |
| Compression Average | 88 | 89 |
| Cover Hardness, Shore C | 81 | 86 |
| CoR @ 125 ft/sec | 0.805 | 0.806 |
| Impact Durability, 600 Hits | no failure | no failure |
| Cold Crack Test, 5° F. | no failure | no failure |
| Light Stability | 3 Hour QUV Test | 5 Days QUV Test |
| ΔY1 | 79.1 | 0.4 |
| Δb* | 40.8 | 0.1 |
| Live Golfer Shear Test* | | |
| Damage Rank | 1 | 1 |
| Appearance Rank | 1 | 1 |

*Rating of Shear Test: Based on a scale of 1–9, 1 is the best, 9 is the worst.

Example 7

Low Free HDI Polyether Urethane Elastomer Composition

A golf ball was made having the cover formulated from the composition in Table 16 including low free HDI polyether urethane elastomer.

TABLE 16

| LOW FREE HDI POLYETHER URETHANE ELASTOMER COMPOSITION | |
|---|---|
| Chemical Components | Weight (g) |
| HDI/PTMEG Prepolymer, 5.77% NCO | 729.64 |
| 1,4-Butanediol | 17.21 |
| S28755PST3 Color Dispersion* | 47.70 |
| Dabco ® T-12 Catalyst | 0.48 |

*S28755PST3 color dispersion is manufactured by PPG Industries.

The physical properties and the ball performance results are listed in Table 17. A control ball made with an aromatic polyurethane is also included in Table 17 for comparison purposes.

TABLE 17

| PHYSICAL PROPERTIES | | |
|---|---|---|
| Ball Properties/Ball Types | Aromatic Control | Invention |
| Nameplate Average | 1.684 | 1.685 |
| Equator Average | 1.683 | 1.683 |
| Weight Average, oz | 1.607 | 1.602 |
| Compression Average | 89 | 89 |
| Cover Hardness, Shore C | 81 | 86 |
| CoR @ 125 ft/sec | 0.804 | 0.809 |
| Impact Durability, 600 Hits | 1 failed @ 550 hits | no failure |
| Cold Crack Test, 5° F. | no failure | no failure |
| Light Stability | 3 Hour QUV Test | 5 Days QUV Test |
| ΔY1 | 79.1 | 1.9 |
| Δb* | 40.8 | 0.8 |
| Live Golfer Shear Test* | | |
| Damage Rank | 1 | 3 |
| Appearance Rank | 1 | 3 |

*Rating of Shear Test: Based on a scale of 1–9, 1 is the best, 9 is the worst.

Example 8

$H_{12}$MDI/Dimerate Polyester Urethane Elastomer

A golf ball was made having the cover formulated from the composition in Table 18 including $H_{12}$MDI/dimerate polyester urethane elastomer.

TABLE 18

| $H_{12}$MDI/DIMERATE POLYESTER URETHANE ELASTOMER COMPOSITION | |
|---|---|
| Chemical Components | Weight (g) |
| $H_{12}$MDI/Hydroxy-Terminated Dimerate Polyester* Prepolymer, 9.10% NCO | 462.64 |
| 1,4-Butanediol | 26.02 |
| S28755PST3 Color Dispersion** | 31.25 |
| Dabco ® T-12 Catalyst | 0.65 |

*Hydroxy-terminated dimerate polyester polyol is manufactured by Uniqema.
**S28755PST3 color dispersion is manufactured by PPG Industries.

The physical properties and the ball performance results are listed in Table 19. A control ball made with an aromatic polyurethane is also included in Table 19 for comparison purposes.

TABLE 19

| PHYSICAL PROPERTIES | | |
|---|---|---|
| Ball Properties/Ball Types | Aromatic Control | Invention |
| Nameplate Average | 1.684 | 1.689 |
| Equator Average | 1.683 | 1.683 |
| Weight Average, oz | 1.607 | 1.605 |
| Compression Average | 89 | 90 |
| Cover Hardness, Shore C | 82 | 84 |
| CoR @ 125 ft/sec | 0.807 | 0.807 |
| Impact Durability, 600 Hits | 1 failed @ 431, 524, 539, 578 hits | no failure |
| Cold Crack Test, 5° F. | no failure | no failure |
| Light Stability | | |
| 5 Days QUV Test | | |
| ΔY1 | | 8.8 |
| Δb* | | 5.2 |
| Live Golfer Shear Test* | | |
| Damage Rank | 1 | 1 |
| Appearance Rank | 1 | 2 |

*Rating of Shear Test: Based on a scale of 1–9, 1 is the best, 9 is the worst.

All patents and patent applications cited in the foregoing text are expressly incorporate herein by reference in their entirety.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A golf ball comprising at least one light stable cover layer formed from a composition comprising at least one castable reactive polyurethane liquid material formed from a saturated polyurethane prepolymer and a saturated curing agent, wherein the saturated polyurethane prepolymer is formed from the reaction product of a saturated diisocyanate and a dimerate polyester polyol.

2. The golf ball of claim 1, wherein the saturated diisocyanate is selected from the group consisting of ethylene diisocyanate; propylene-1,2-diisocyanate; tetramethylene diisocyanate; tetramethylene-1,4-diisocyanate; 1,6-hexamethylene-diisocyanate; octamethylene diisocyanate; decamethylene diisocyanate; 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane -1,2-diisocyanate; cyclohexane-1,3-diisocyanate; cyclohexane-1,4-diisocyanate; methyl-cyclohexylene diisocyanate; 2,4-methylcyclohexane diisocyanate; 2,6-methylcyclohexane diisocyanate; 4,4'-dicyclohexyl diisocyanate; 2,4-dicyclohexyl diisocyanate; 1,3,5-cyclohexane triisocyanate; isocyanatomethylcyclohexane isocyanate; 1-isocyanato-3,3,5-trimethyl-5-isocyanatomethylcyclohexane; isocyanatoethylcyclohexane isocyanate; bis(isocyanatomethyl)-cyclohexane diisocyanate; 4,4'-bis(isocyanatomethyl) dicyclohexane; 2,4'-bis(isocyanatomethyl) dicyclohexane; isophoronediisocyanate; triisocyanate of HDI; triisocyanate of 2,2,4-methyl-1,6-hexane diisocyanate; 4,4'-dicyclohexylmethane diisocyanate; 2,4-hexahydrotoluene diisocyanate; 2,6-hexahydrotoluene diisocyanate; trimerized isocyanurate of any polyisocyanate; dimerized uretdione of any polyisocyanate; modified polyisocyanate; and mixtures thereof.

3. The golf ball of claim 2, wherein the saturated diisocyanate is selected from the group consisting of isophoronediisocyanate, 4,4'-dicyclohexylmethane diisocyanate, 1,6-hexamethylene diisocyanate, or a combination thereof.

4. The golf ball of claim 1, wherein the saturated curing agent is selected from the group consisting of hydroxy-terminated curing agents, amine-terminated curing agents, and mixtures thereof.

5. The golf ball of claim 4, wherein the hydroxy-terminated curing agents are selected from the group consisting of ethylene glycol; diethylene glycol; polyethylene glycol; propylene glycol; 2-methyl-1,3-propanediol; 2,-methyl-1,4-butanediol; dipropylene glycol; polypropylene glycol; 1,2-butanediol; 1,3-butanediol; 1,4-butanediol; 2,3-butanediol; 2,3-dimethyl-2,3-butanediol; trimethylolpropane; cyclohexyldimethylol; triisopropanolamine; tetra-(2-hydroxypropyl)-ethylene diamine; diethylene glycol di-(aminopropyl ether; 1,5-pentanediol; 1,6-hexanediol; 1,3-bis-(2-hydroxyethoxy) cyclohexane 1,4-cyclohexyldimethylol; 1,3-bis-[2-(2-hydroxyethoxy) ethoxy]cyclohexane; 1,3-bis-{2-[2-(2-hydroxyethoxy) ethoxy]ethoxy}cyclohexane; trimethylolpropane; polytetramethylene ether glycol; and mixtures thereof.

6. The golf ball of claim 5, wherein the polytetramethylene ether glycol has a molecular weight from about 250 to about 3900.

7. The golf ball of claim 4, wherein the amine-terminated curing agents are selected from the group consisting of ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino) -dicyclohexylmethane; 1,4-bis-(sec-butylamino)-cyclohexane; 1,2-bis-(sec -butylamino)-cyclohexane; derivatives of 4,4'-bis-(sec-butylamino) -dicyclohexylmethane; 4,4'-dicyclohexylmethane diamine; 1,4-cyclohexane-bis -(methylamine); 1,3-cyclohexane-bis-(methylamine); diethylene glycol di-(aminopropyl) ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; imido-bis-propylamine; monoethanolamine, diethanolamine; triethanolamine; monoisopropanolamine, diisopropanolamine; isophoronediamine; and mixtures thereof.

8. The golf ball of claim 1, wherein the material further comprises a catalyst selected from the group consisting of a bismuth catalyst, an oleic acid, triethylenediamine, di-butyltin dilaurate, acetic acid, and mixtures thereof.

9. The golf ball of claim 1, wherein the cover layer has a difference in yellowness index of about 12 or less after 5 days of ultraviolet light exposure.

10. The golf ball of claim 1, wherein the cover layer has a difference in b chroma dimension of about 6 or less after 5 days of ultraviolet light exposure.

11. A golf ball comprising:

a core;

a layer disposed about the core forming a center; and a cover cast onto the center, wherein the cover comprises a saturated castable reactive liquid polyurethane material comprising a saturated diisocyanate, a dimerate polyester polyol, and at least one of a saturated hydroxy-terminated curing agent, a saturated amine-terminated curing agent, or a mixture thereof.

12. The golf ball of claim 11, wherein the layer comprises a saturated polyurethane composition.

13. The golf ball of claim 11, wherein the cover has a thickness of about 0.02 inches to about 0.35 inches.

14. The golf ball of claim 11, wherein the layer thickness of the is about 0.02 inches or greater.

15. A golf ball comprising a core, an inner cover layer, and an outer cover layer, wherein the outer cover layer comprises a composition comprising a saturated polyurethane prepolymer formed from the reaction product of a saturated isocyanate and a saturated dimerate polyester polyol and a curing agent, wherein the outer cover layer has a difference in yellowness index of about 12 or less after 5 days of ultraviolet light exposure.

16. The golf ball of claim 15, wherein the outer cover layer has a difference in yellowness index of about 2 or less after 5 days of ultraviolet light exposure.

17. The golf ball of claim 15, wherein the curing agent is a saturated hydroxy-terminated curing agent.

18. The golf ball of claim 17, wherein the saturated hydroxy-terminated curing agent is selected from the group consisting of ethylene glycol; diethylene glycol; polyethylene glycol; propylene glycol; 2-methyl-1,3-propanediol; 2,-methyl-1,4-butanediol; dipropylene glycol; polypropylene glycol; 1,2-butanediol; 1,3-butanediol; 1,4-butanediol; 2,3-butanediol; 2,3-dimethyl-2,3-butanediol; trimethylolpropane; cyclohexyldimethylol; triisopropanolamine; tetra -(2-hydroxypropyl)-ethylene diamine; diethylene glycol di-(aminopropyl)ether; 1,5-pentanediol; 1,6-hexanediol; 1,3-bis-(2-hydroxyethoxy)cyclohexane; 1,4-cyclohexyldimethylol; 1,3-bis-[2-(2-hydroxyethoxy) ethoxy]cyclohexane; 1,3-bis-{2-[2-(2-hydroxyethoxy) ethoxy]ethoxy}cyclohexane; trimethylolpropane; polytetramethylene ether glycol; and mixtures thereof.

* * * * *